United States Patent [19]

Weber

[11] Patent Number: 4,985,962

[45] Date of Patent: Jan. 22, 1991

[54] COMBINATION LATCH-HINGE DEVICE

[75] Inventor: Ronald M. Weber, Lebanon, Pa.

[73] Assignee: AMP Incorporated, Harrisburg, Pa.

[21] Appl. No.: 550,603

[22] Filed: Jul. 10, 1990

[51] Int. Cl.[5] ..... E05D 15/50

[52] U.S. Cl. ..... 16/232; 16/231; 292/87; 292/DIG. 38

[58] Field of Search ..... 16/231, 232

[56] References Cited

U.S. PATENT DOCUMENTS 505,480 9/1893 Pletcher ..... 16/232

4,479,675 10/1984 Zankl ..... 16/232 X

FOREIGN PATENT DOCUMENTS 0027006 4/1931 Australia ..... 16/232

*Primary Examiner*—Richard K. Seidel

*Assistant Examiner*—Patty E. Hong

*Attorney, Agent, or Firm*—Allan B. Osborne

[57] ABSTRACT

A device (36) capable of functioning both as a latch and a hinge is disclosed. The device (36) includes a latch section (16) mounted on the housing (12) of an enclosure (10) and includes a groove (88) and a movable latch member (40) extending over the groove (88). The device (36) further includes a hinge section (30) mounted on the cover (14) and includes a rod (32) which is received in the groove (88) and rotatably retained therein by the latch member (40).

4 Claims, 7 Drawing Sheets

COMBINATION LATCH-HINGE DEVICE

FIELD OF THE INVENTION

The invention disclosed herein relates to a combination latch-hinge device so that a cover of an enclosure may be opened from either one of two opposite sides.

BACKGROUND OF THE INVENTION

On typical enclosures used in the telecommunication industry traditional hinging devices permit the cover to be opened from one side only. When such an enclosure is being installed on a pole or elsewhere, orientation thereof is extremely important but unfortunately often overlooked. Accessibility then may be limited almost to the extent that a lineman's ability to do a proper job on the devices within the enclosure suffers. Accordingly it is now proposed to provide an enclosure having a cover mounted thereon with combination latch-hinge devices such that the cover may be opened from either side thereof.

SUMMARY OF THE INVENTION

According to the invention, a combination latch-hinge device is provided which includes a latch section mounted on opposite sides of the housing of an enclosure and a hinge section mounted on opposite sides of the cover of the enclosure. The latch section includes grooves which are spaced out from and is parallel to the sides or the housing and a latch which removably extends over a portion of the groove. The cooperating hinge section includes a rod which is spaced out from and is parallel to the sides of the cover. The rod is received in the groove and is rotatably retained therein by the latch.

DESCRIPTION OF THE INVENTION

Figure 1:
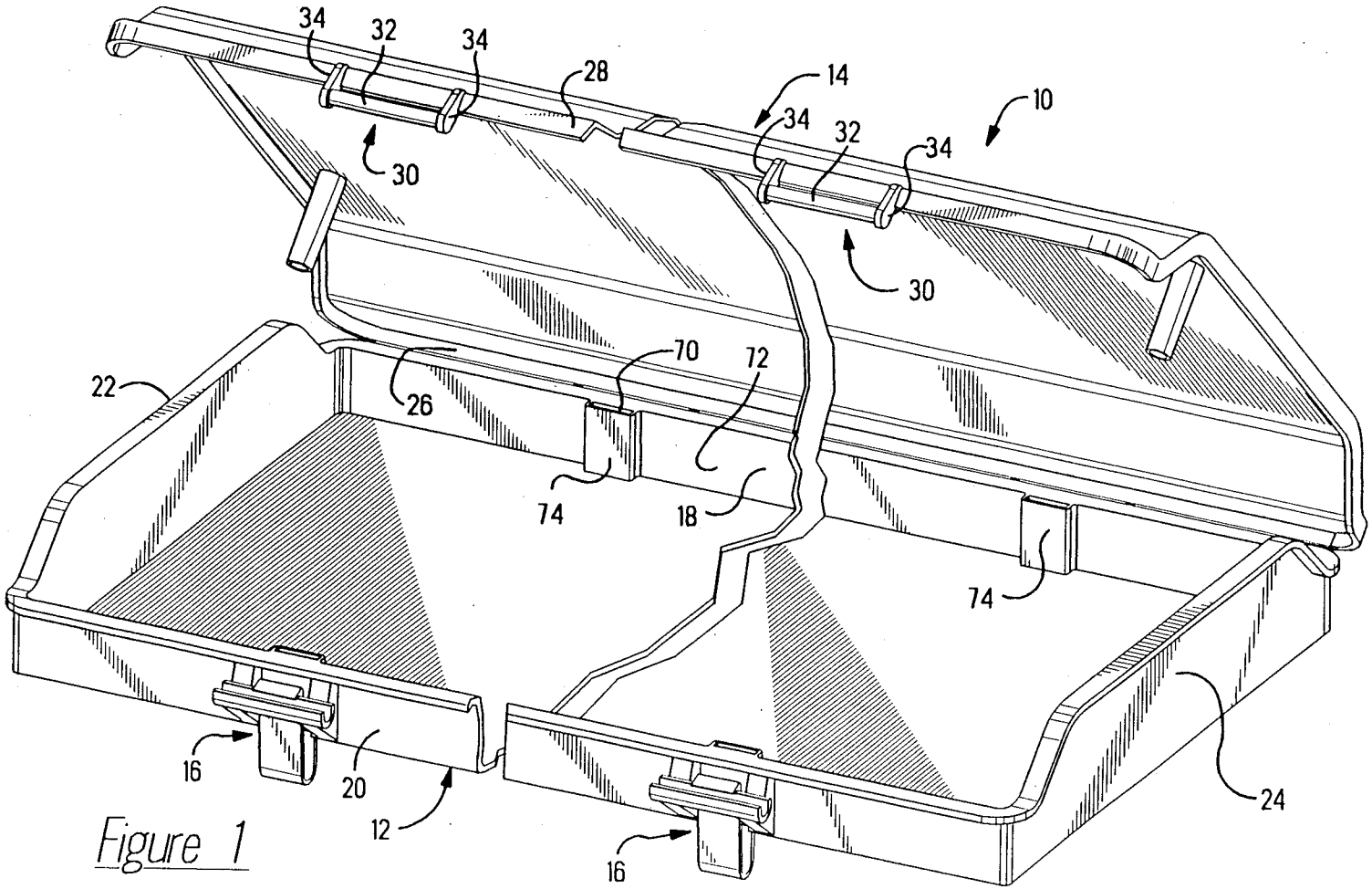
FIGS. 1 and 2 are perspective views of an enclosure having a cover rotatably attached to a housing by a combination latch-hinge device constructed in accordance with one embodiment of the present invention.
Figure 2:
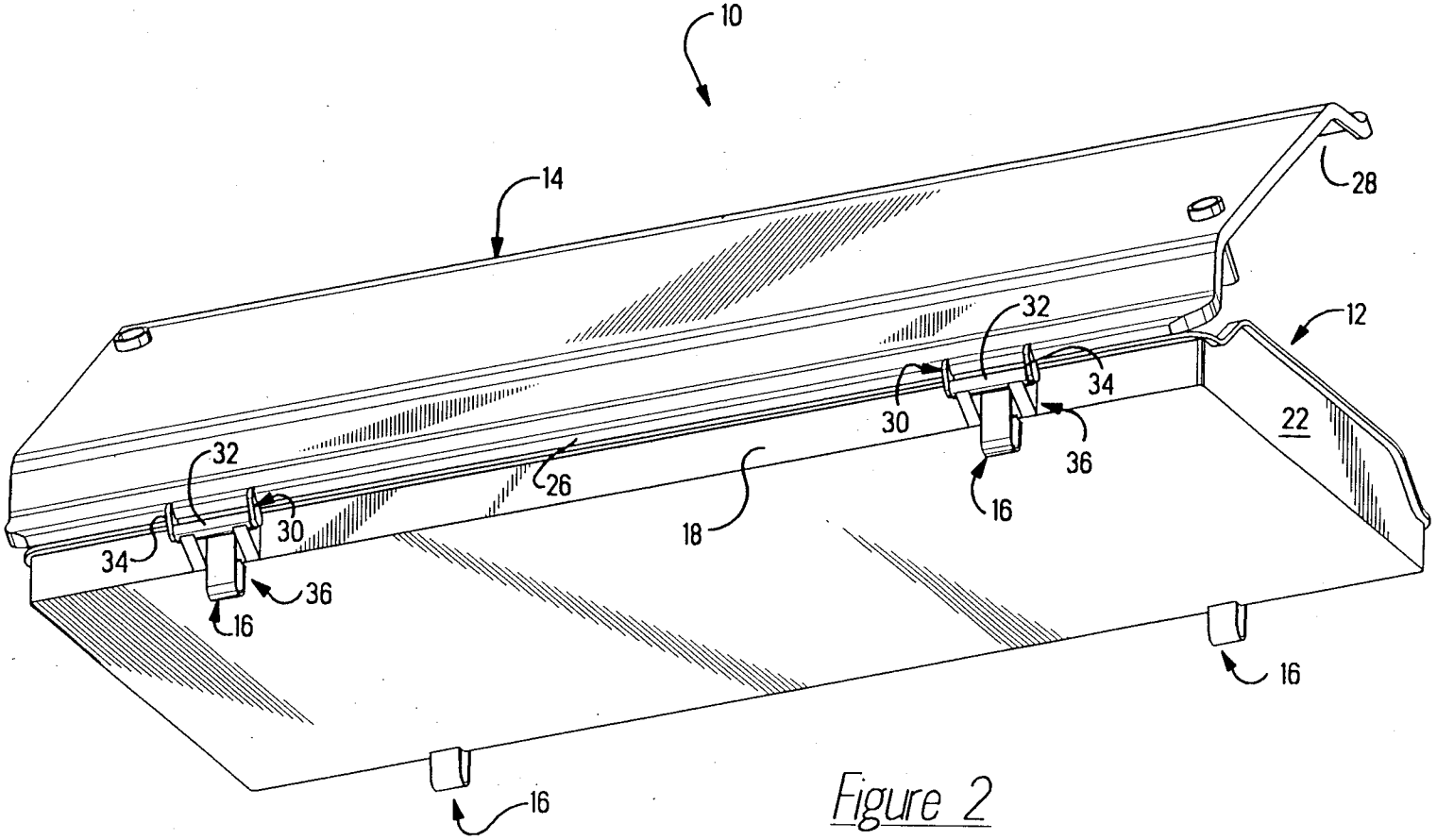

Referring to FIGS. 1 and 2, enclosure 10 includes housing 12 and cover 14. Both components are preferably molded from a suitable plastics material such as a polycarbonate and include gasket or other means for moisture-proofing the interior of a closed enclosure 10.

Housing 12 includes latch section 16 of the present invention on opposing side walls 18, 20. As shown, two sections 16 are positioned on each side wall 18, 20 near respective end walls 22, 24.

Cover 14 carries on both lateral edges 26, 28 hinge sections 30 which include rod. 32, which is parallel to edges 26, 28 and support arms 34 which space rod 32 outwardly from edges 26, 28. Hinge sections 30 are spaced on respective edges 26, 28 to cooperate with latch sections 16 to form latch-hinge devices 36 of the present invention.

Figure 3:
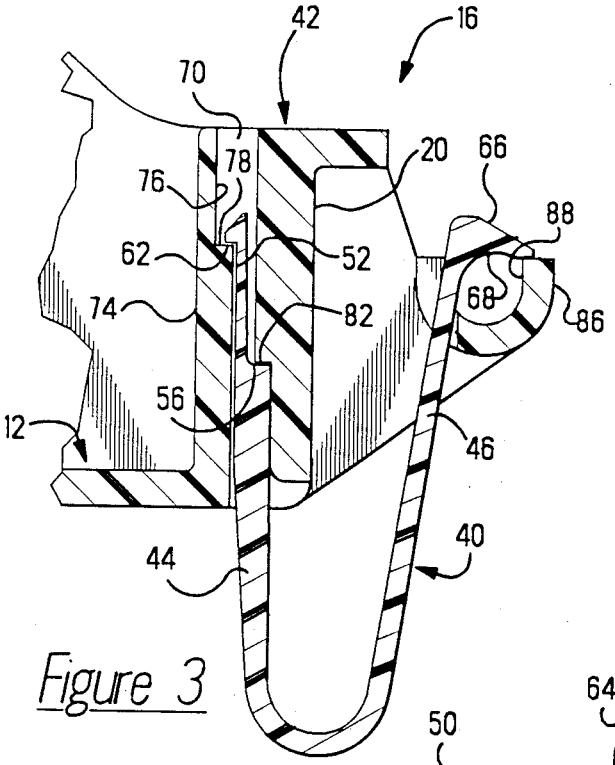
FIG. 3 is a cross-sectional view of the latch section of the device.
Figure 4:
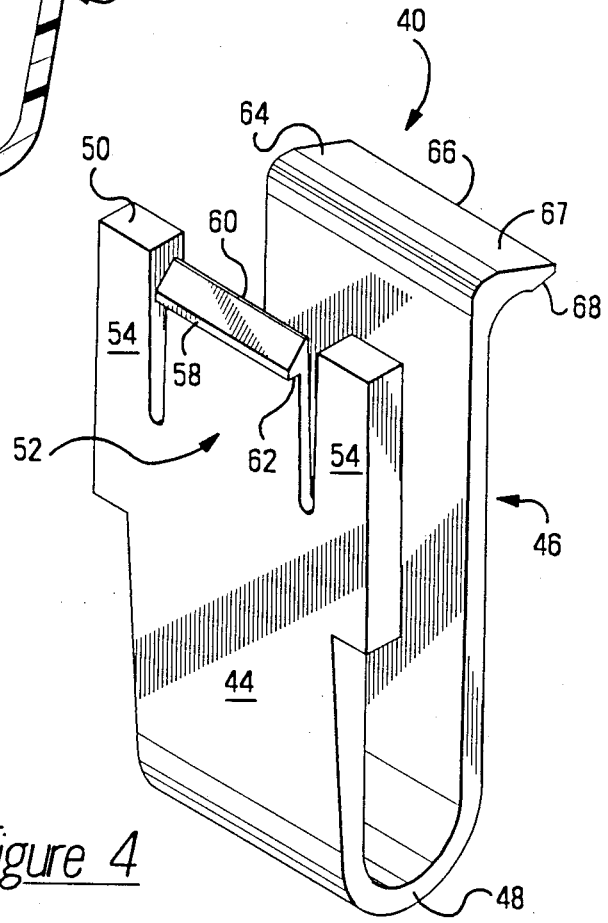
FIG. 4 is a perspective view of the latching member of the latch section.

FIG. 3 shows the details of latch section 16. Included is a U-shaped member 40 and cooperating structure 42 on sidewalls 18, 20. As seen more clearly in FIG. 4, member 40 includes legs 44, 46 which are joined at one end by curved bight 48 and which diverge slightly therefrom. First leg 44 thickens towards free end 50 where it is trifurcated to provide a wide finger 52 located between, a pair of posts 54. As shown in FIG. 3, finger 52 is reduced in thickness relative to posts 54 and the rest of first leg 44 to provide flexibility. Further, the reduced thickness of finger 52 provides an upwardly facing shoulder 56. A lateral lip 58, projecting outwardly (away from second leg 46) from free end 60 of finger 52, provides a downwardly facing shoulder 62.

Figure 5:
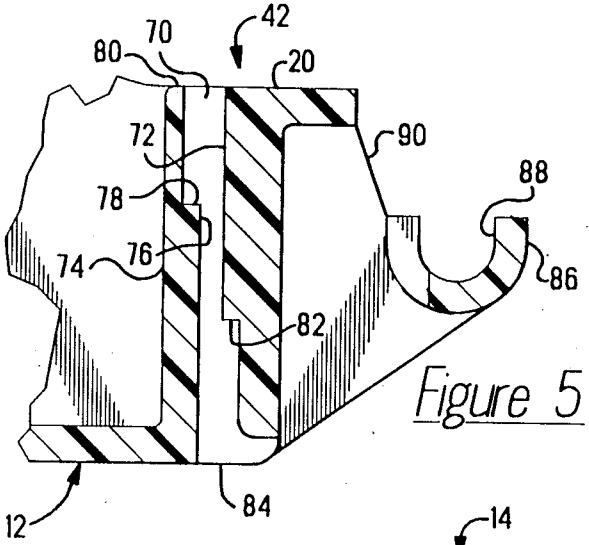
FIG. 5 is a cross-sectional view of the latch structure on the housing.

Second leg 46 is provided, at its free end 64, with an outwardly (away from first leg 44) projecting lip 66 which includes an upwardly facing beveled surface 67 and a downwardly facing beveled portion 68. With reference particularly to FIG. 5, each cooperating structure 42 includes a slot 70 which is defined by inside surfaces 72 of respective sidewalls 18, 20 and a U-shaped partition 74 attached to inside surfaces 72 as shown in FIG. 1. Surfaces 76 of partitions 74 which face slot 70 include an upwardly facing shoulder 78 just below upper edge 80. A downwardly facing shoulder 82 is provided on inside surfaces 72 just above lower edge 84.

Structure 42 further includes a U-shaped rail 86 which provides a laterally and upwardly open groove 88. Rail 86, which parallels sidewalls 18, 20, is supported at each end by support arms 90 which project normally outwardly from respective sidewalls 18, 20.

Returning to FIG. 3, U-shaped member 40 is attached to cooperating structure 42 by first leg 44 being inserted into slot 70 and second leg 46 positioned between respective sidewall 18, 20 and rail 86. Member 40 is retained within structure 42 by cooperation between shoulders 62, 56 on first leg 44 and shoulders 78, 82 on surfaces 76, 72 respectively. As shown, lip 66 on second leg 46 projects over groove 88 in rail 86.

Figure 6:
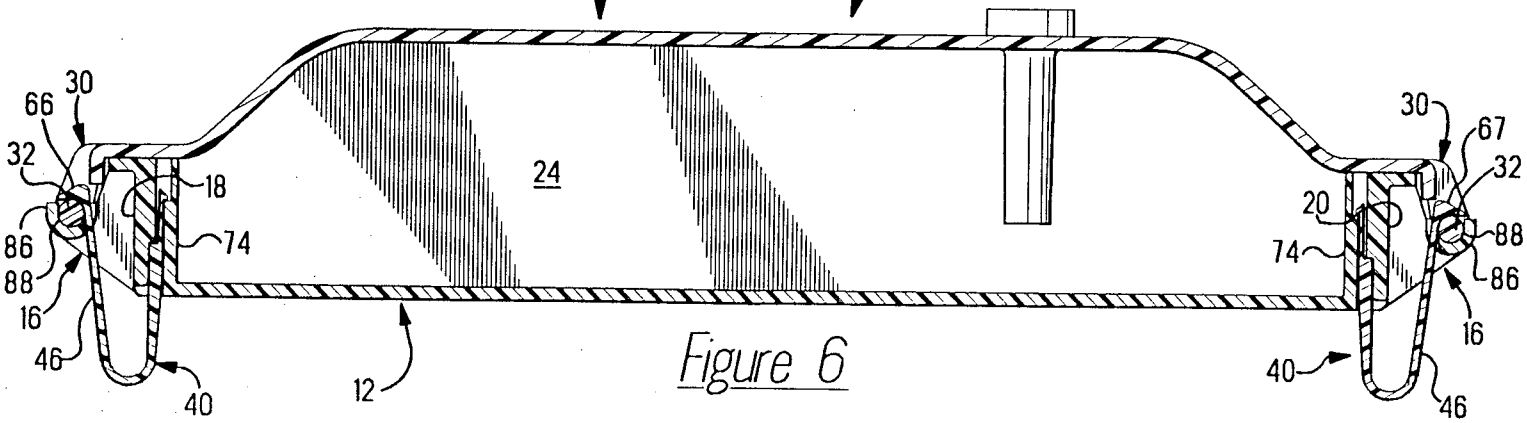
FIG. 6 is a cross-sectional view of the closed enclosure showing the device on two opposite sides thereof.

FIG. 6 shows cover 14 secured to housing 12 to form enclosure 10. Rods 32 of the cover's hinge sections 30 are received in grooves 88 in rails 86 of latch sections 16 and are retained therein by lips 66 on second legs 46 of U-shaped members 40.

Figures 7, 8:
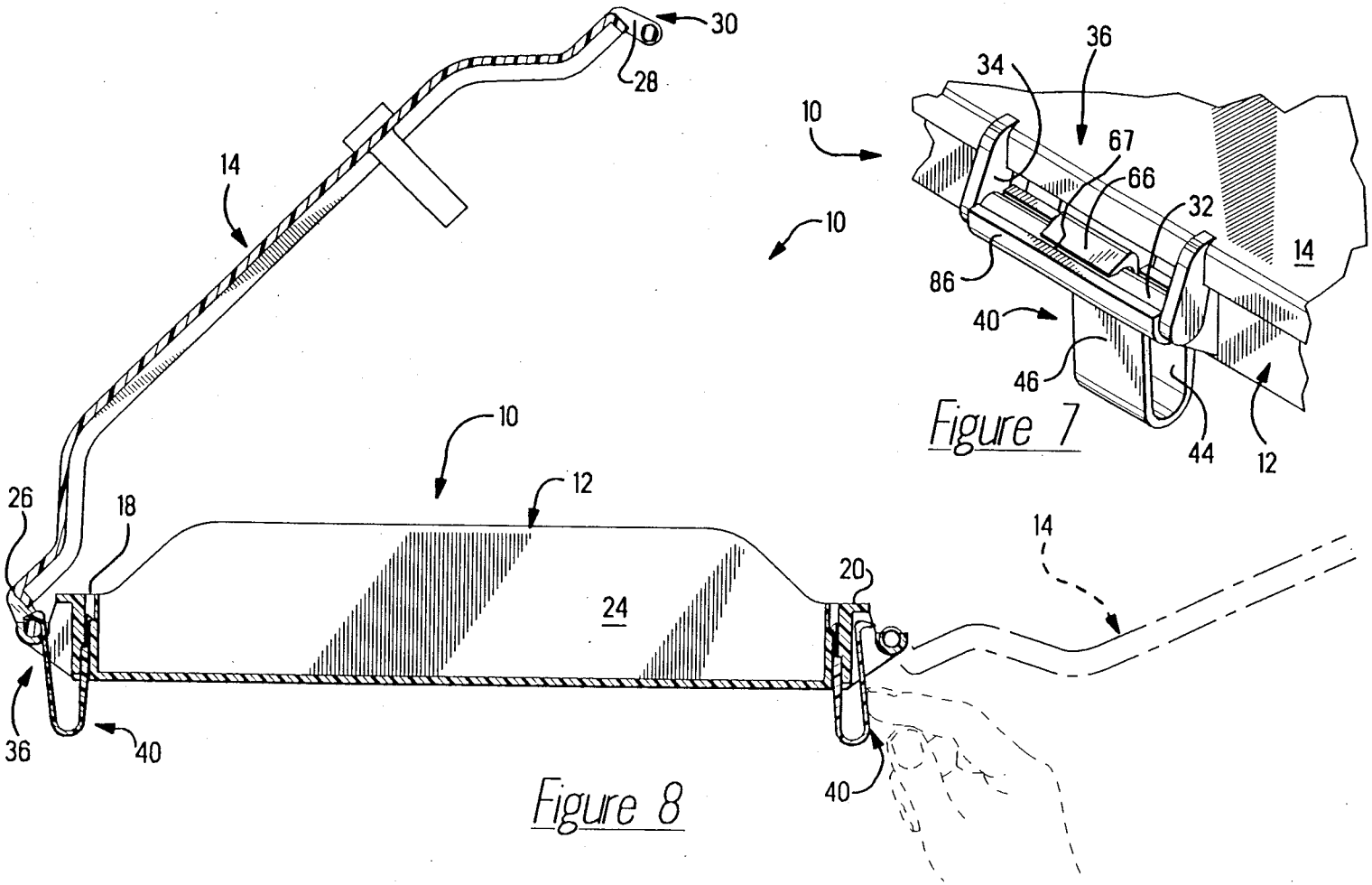
FIG. 7 is an enlarged perspective view showing the device mounted on the enclosure.
FIG. 8 is a cross-sectional view of the enclosure showing the cover in an open position.

FIG. 7 is an enlarged view of one latch-hinge device 36 showing more clearly the relation of the several components in the closed and latched position.

In closing cover 14, lips 66 can be cammed out of the way by rods 32 riding down the upwardly facing beveled surface 67. Alternatively lips 66 can be moved out of the way by pressing resilient second leg 46 in towards respective sidewalls 18, 20.

Cover 14 is opened by simply pressing in on resilient second legs 46 on either side of enclosure 10. FIG. 8 shows cover 14 pivoted open around the hinge-latch devices 36 on side 18 of housing 12. The drawing also shows, in phantom, cover 14 opened around hinge-latch devices 36 on side 20 of housing 12.

An alternative embodiment (not shown) of member 40 includes placing projecting lip 66 on the inside surface of second leg 46 and positioning leg 46 on the outside of rail 86.

Figure 9:
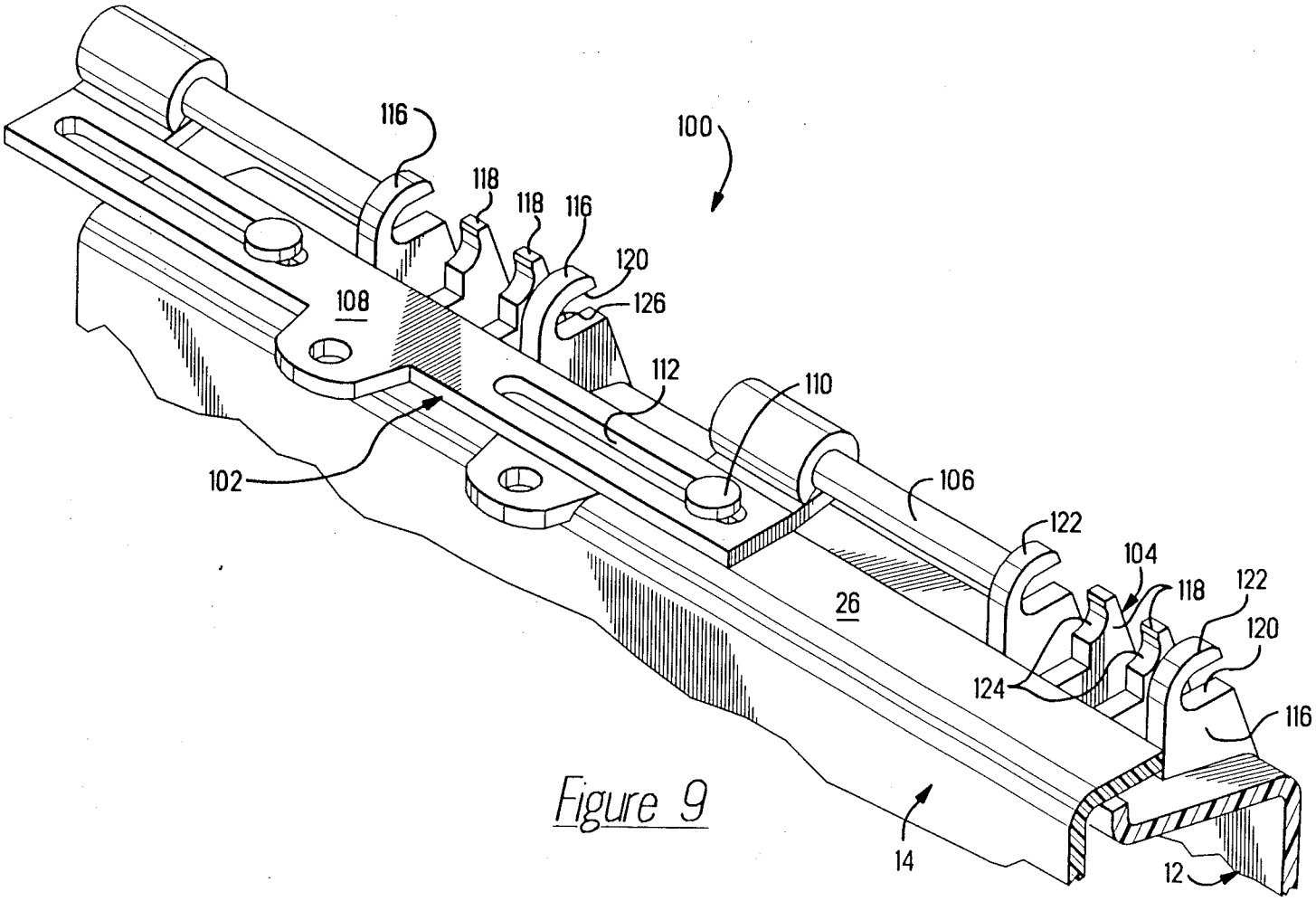
FIG. 9 and 10 are perspective views of an alternate embodiment of the combination latch-hinge device.
Figure 10:
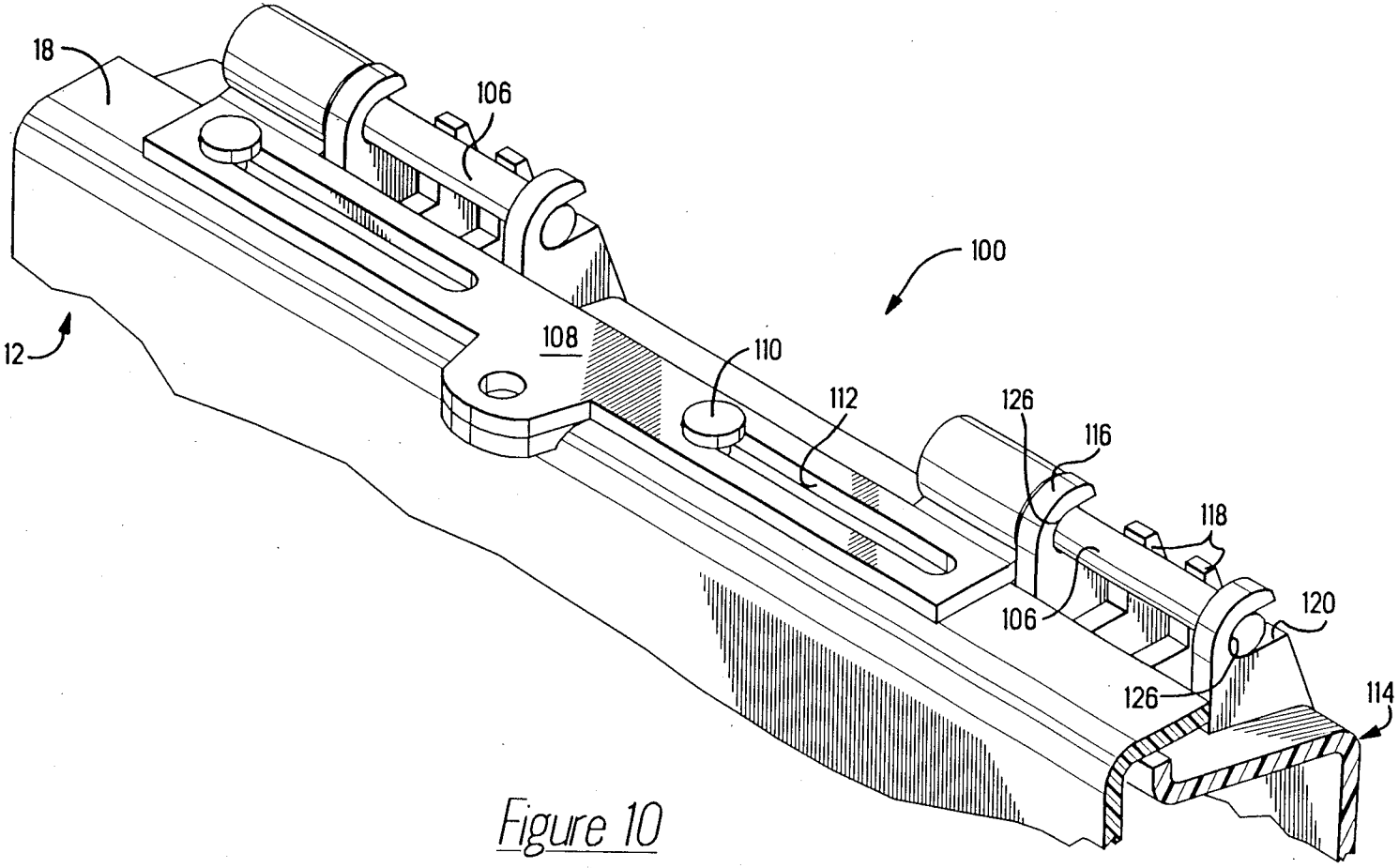

FIGS. 9 and 10 illustrate another embodiment of the present invention. Latch-hinge device 100 includes hinge section 102 and latch section 104.

Hinge section 102 includes rods 106 which are attached to plate 108. Plate 108 in turn is slidingly attached to respective sides 26, 28 of cover 14 by pins 110 which pass through elongated grooves 112 in plate 108.

Housing 12 carries latch section 104 which includes a pair of spaced apart arms 116 and a pair of spaced apart fingers 118 located between arms 116. Arms 116 are provided with U-shaped slots 120 adjacent free ends 122 and which are open away from cover 14. Fingers 118 include arcuate surfaces 124 which face towards cover 14 and are spaced from the base 126 of slots 120 by the diameter of rod 106.

To latch housing 12 to cover 14 hinge section 102 is moved so that rods 106 enter both slots 120 on respective latch sections 104. As shown in FIG. 10, rods 106 are positioned between bases 126 on one side and arcuate surfaces 124 on an opposite side. Housing 12 cannot fly open at that side but can rotate about rods 106.

As can be discerned, a combination latch-hinge device for use on enclosures having a housing and a cover has been disclosed. In one embodiment, the latch section of the device includes a U-shaped member on the housing and which has a resilient leg with an outwardly projecting lip which extends over a groove. The hinge section of the device includes a rod attached to the cover and which is received in the groove. The lip extends over the rod to retain the cover in a closed position but also cooperates with the rod so that the cover can be rotated thereabout. Pressing in on the resilient leg releases the rod from the groove so that the cover can be opened.

I claim:

1. A device capable of functioning either as a latch or as a hinge for use on enclosures having a housing and a cover so that the cover may be rotatably opened from either of two opposite sides of the housing, said device comprising:

latch sections mounted on two opposite sides of a housing, said sections including first means and cooperating latching means wherein said first means include grooved rails parallel to and spaced outwardly from respective sides by support arms and said latching means include latching members having a leg with a lip thereon which extends over respective said grooved rails, said leg being between said rail and respective said sides and movable theretowards to remove said lip from over said grooved rail; and hinge sections mounted on two opposite sides of the cover in registration with said latch sections when the cover closes over the housing, said hinge sections having a rod spaced outwardly from and in parallel relation to respective sides for being received in said grooves and removably retained therein by said latching member.

2. The device of claim 1 wherein said latching means includes a U-shaped member with a first leg being retained by the housing and a second leg extending between the housing and said first means and having an outwardly projecting lip thereon which extends over at least a portion of said groove, said second leg being movable towards said housing to remove said lip from over said groove.

3. The device of claim 2 wherein the respective sides include slots for receiving and retaining said first legs.

4. A device capable of functioning either as a latch or as a hinge for use on enclosures having a housing and a cover so that the cover may be rotatably opened from either of two opposite sides of the housing, said device comprising:

latch sections mounted on two opposite sides of either the housing or the cover and including pairs of spaced apart arms projecting normally outwardly from respective sides, said arms being provided with openings therethrough with said openings being parallel to the sides; and hinge sections mounted on two opposite sides of either the housing or the cover not having said latch sections, said hinge sections being in registration with said latch sections when the cover closes over the housing, said hinge section including cylindrical rods slidably mounted on and in parallel relation to the respective sides and adapted to slide into said openings.

* * * * *